US010605078B2

(12) United States Patent
Zhao et al.

(10) Patent No.: US 10,605,078 B2
(45) Date of Patent: Mar. 31, 2020

(54) ENERGY-ABSORBING ROCKBOLT

(71) Applicant: Northeastern University, Shenyang (CN)

(72) Inventors: Xing dong Zhao, Shenyang (CN); Xiao ming Yang, Shenyang (CN); Jia an Niu, Shenyang (CN)

(73) Assignee: Northeastern Univeristy, Shenyang, Liaoning Province (CN)

( * ) Notice: Subject to any disclaimer, the term of this patent is extended or adjusted under 35 U.S.C. 154(b) by 0 days.

(21) Appl. No.: 16/321,765

(22) PCT Filed: May 21, 2018

(86) PCT No.: PCT/CN2018/087697

§ 371 (c)(1),
(2) Date: Jan. 29, 2019

(87) PCT Pub. No.: WO2019/178932

PCT Pub. Date: Sep. 26, 2019

(65) Prior Publication Data

US 2020/0011178 A1 Jan. 9, 2020

(30) Foreign Application Priority Data

Mar. 23, 2018 (CN) ..... 2018 1 0243640

(51) Int. Cl.
*E21D 21/00* (2006.01)

(52) U.S. Cl.
CPC ..... *E21D 21/008* (2013.01); *E21D 21/0046* (2013.01)

(58) Field of Classification Search
CPC ..... E21D 21/008; E21D 21/0046
See application file for complete search history.

(56) References Cited

U.S. PATENT DOCUMENTS 4,091,882 A * 5/1978 Hashimoto ..... B23B 51/0045 175/286
4,303,354 A * 12/1981 McDowell, Jr. ..... E21D 21/008 405/259.5

(Continued)

FOREIGN PATENT DOCUMENTS

| | | |
|---|---|---|
| CN | 205370611 U | 7/2016 |
| CN | 107725088 A | 2/2018 |
| EP | 0274166 A1 | 7/1988 |

*Primary Examiner* — Benjamin F Fiorello
(74) *Attorney, Agent, or Firm* — Muncy, Geissler, Olds & Lowe, P.C.

(57) ABSTRACT

An energy-absorbing rockbolt includes an anchorage structure, wherein two ends of the anchorage structure are respectively provided with a mixing blade and a threaded fastening section; a nut is screwed to the threaded fastening section; a plate is mounted at one end, which is close to the threaded fastening section, of the anchorage structure in a sleeving manner; one side of the plate abuts against the nut; the anchorage structure consists of first anchorage structure parts and second anchorage structure parts, wherein the second anchorage structure parts are arranged between two first anchorage structure parts; each of the second anchorage structure parts is an elliptical rod-shaped structure; a plurality of inwardly-concave arc-shaped grooves are formed in an outer wall of the second anchorage structure part in an axial direction, and a reinforcing rib is convexly formed at an intersection of two adjacent arc-shaped grooves.

8 Claims, 4 Drawing Sheets

(56) References Cited

U.S. PATENT DOCUMENTS

| | | | | |
|---|---|---|---|---|
| 5,649,789 | A * | 7/1997 | Denz | E21B 10/445 405/259.1 |
| 8,485,758 | B2 * | 7/2013 | Cai | E21D 21/0033 405/259.1 |
| 8,753,042 | B1 | 6/2014 | Thompson et al. | |
| 2007/0243026 | A1 * | 10/2007 | Wu | E21D 20/025 405/259.5 |
| 2011/0268526 | A1 * | 11/2011 | Wu | E21D 21/008 411/1 |
| 2012/0114426 | A1 * | 5/2012 | Kenny | E21D 21/008 405/259.4 |
| 2018/0016900 | A1 * | 1/2018 | Ma | C21D 1/26 |
| 2019/0100998 | A1 * | 4/2019 | Pastorino | E21D 21/0066 |

* cited by examiner

ENERGY-ABSORBING ROCKBOLT

BACKGROUND OF THE INVENTION

1. Field of the Invention

The present invention relates to the technical field of mine dynamic support, in particular to an energy-absorbing rockbolt.

2. The Prior Arts

A rockbolt is the most commonly-used supporting material in mining engineering, underground construction, railway engineering, highway engineering, hydraulic engineering, tunneling engineering and the like, which has various types, high application volume and wide application range, and can effectively control the engineering stability of rock mass. The bolt support with a metal mesh, sprayed concrete and the like can effectively control deformation and damage of the surrounding rock of a roadway (underground cavern, tunnel, and the like). As the mining depth of a metal mine increases, the ground stress increases, and under the action of high stress and dynamic impact, ground pressure disasters, such as spalling, bulking, rockburst or brittle-ductile deformation etc., occur in the surrounding rock of the roadway. Under the conditions of high stress, large deformation and strong dynamic disturbance, supporting a roadway (tunnel) by using a conventional friction type or mechanical type rockbolt cannot effectively control the stability of the surrounding rock of the roadway, and severe destruction can cause damage to equipment, casualties, loss of mineral resources, and the like. Therefore, development of energy-absorbing rockbolts applicable to high stress, rockburst or large deformation of the rock mass due to brittle-ductile deformation becomes an inevitable trend in the future.

The characteristic scientific phenomena of the engineering response of the surrounding rock of the roadway in a deep mine can be summarized into two categories: static and dynamic, according to occurrence reasons. The static characteristic phenomenon presents as controlled destruction or rock brittle destruction without dynamic ejection on the structure surface of the surrounding rock of a deep roadway; the dynamic characteristic phenomenon presents as rockburst such as rock ejection and caving of rock masses in deep mines. Rockburst is the phenomenon that the potential energy of elastic deformation accumulated in the rock is suddenly and violently absorbed under certain conditions, causing the rock to burst and eject. The dynamic response characteristics of the surface of the surrounding rock of the roadway induced by rockburst are mainly presented as slabing, rock ejection, bursting and spalling, throwing damage of the rock mass, and the like. The most significant dynamic damage characteristic is that the rock mass is ejected from the surface of the surrounding rock of the roadway (stope) at high speed. The rock mass with 1 m-thickness surface can be thrown into the roadway at the speed of 5-10 m/s, the throwing distance can reach 10-20 m, the ejection energy is 5-20 $KJ/m^2$, and the maximum ejection energy can reach 50 $KJ/m^2$. The dynamic response of the rock mass induced by rockburst varies with different rockburst grades. The rock with a light rockburst presents as flaky spalling, while a strong rockburst can throw out huge rocks violently, even one rockburst can throw out tons of rock blocks and rock slices, and the safety of underground operators and equipment is seriously threatened.

Under the environments of high stress, rockburst-prone and large deformation, the dynamic characteristics become key parameters for the selection and design of the supporting system. In fact, when the supporting system is selected, the influences of factors, such as drilling diameters, stress environment, corrosion and cementing materials (cement or resin), need to be considered, and the influence of the factors on different stress environments should be understood. A novel dynamic (yielding) supporting rockbolt (such as novel cone bolt, yielding cable and yielding rockbolt), due to limited application range, needs to be constantly improved according to specific conditions so as to meet the requirements of various different working conditions (equipment requirements, load bearing capacity, stiffness characteristics, and the like).

As early as the 1990s, South Africa firstly proposed an energy absorption supporting system and invented the first energy-absorbing rockbolt, namely Cone bolt, in the world. The cone bolt is mainly formed by forging one end of round steel into a flat conical shape and spraying a thin layer of lubricating materials onto the surface of the round steel, so that the rockbolt can be easily separated under the action of dynamic load. Such rockbolt is usually anchored at the full length by using cement grout or resin. When the rock anchored between a rockbolt tray and a cone bursts under the dynamic action, the anchorage structure can bear tension and dynamic impact. When the drawing force exceeds a preset value, the cone at the anchoring end can slide in an anchor. Therefore, the rockbolt provides large sliding displacement under the action of dynamic impact and absorbs kinetic energy generated by rockburst. The rockbolt was initially designed to be anchored with cement grout and then adjusted to be anchored with resin. The novel cone bolt has the improved function of resin mixing at the end head of the rockbolt, and is widely used for supporting of deep mine roadways where rockburst disasters are easy to induce, in Canada, South Africa, and the like.

The energy-absorbing supporting rockbolts used internationally are mainly as follows:

Durabar Rockbolt is a rockbolt improved based on the cone bolt. Folds are designed in the smooth anchorage structure, and the tail of the rockbolt is designed into a smooth ring. When the drawing force test is performed, a plate bears the load, and the rockbolt slides along a waveform surface. The maximum sliding displacement is equal to the length of the tail of the rockbolt (about 0.6 m), so that the rockbolt belongs to a two-point anchoring rockbolt. But such rockbolt is not tested for dynamics.

Swellex Rockbolt is a typical expandable rockbolt which anchors the rock mass mainly through the friction force between the anchorage structure and the pipe wall of the rockbolt hole. The newly-developed Mn24 type Swellex rockbolt has good energy absorption capacity, with an energy absorption range of 18-29 kJ.

Garford Rigid Rockbolt is a rockbolt which mainly consists of round steel, an anchoring head and a coarse threaded rebar sleeve and is resin for anchoring. The coarse threaded rebar sleeve is mainly used for stirring resin. The engineering anchoring head of the rockbolt can produce high displacement. The anchoring head is made of thick-walled round steel and is pressed into the steel sleeve for a depth of 350 mm. The round steel is compressed to the original diameter size and inserted into the coarse threaded rebar sleeve. When the compressed rock between the anchoring end and the plate expands, the round steel is pulled out from the anchoring end. When the round steel is pulled out, the anchoring force remains unchanged, and the rockbolt can produce the displacement of 390 mm.

Roofex Rockbolt is a dynamic ductile rockbolt which consists of an anchoring end and round steel and is resin for anchoring. The round steel slides in the anchoring end. 80 kN constant supporting resistance is produced. The anchoring force of the rockbolt is lower than the tensile strength of the round steel. The Roofex rockbolt has a dynamic load of about 60 kN and a power test energy of 12 kJ-27 kJ.

D Rockbolt is a rockbolt which consists of round steel with a certain number of anchoring points at certain intervals. After the rockbolt is mounted, since the anchoring point is wider than the round steel in diameter, the rockbolt is anchored in the rockbolt hole at the full length with resin or cement grout. The round steel and the anchor between two anchoring points are in weak cementing. When the rock mass between two anchoring points expands, the strength and the deformation capacity of the round steel between the two anchoring points play a leading role, and tensile length of 200 mm is produced. When the load is 200 kN, the tensile displacement of the rockbolt is 100-120 mm, and the energy bearing the impact load is 36-39 kJ. Therefore, a novel energy-absorbing rockbolt which can effectively control the rockburst disaster is developed, so as to realize "explosion without falling", leave enough safety space to ensure the safety of the operators and mechanical equipment, and provide technical guarantee for the safe and efficient exploitation of deep mining and high-stress ore bodies in China.

When dynamic disasters such as deep mine rockburst occur, the energy-absorbing rockbolt anchored in the rock mass has the dynamic energy absorbing and yielding capability while maintaining high drawing force. Therefore, the novel energy-absorbing rockbolt is developed to meet the above requirements.

SUMMARY OF THE INVENTION

The present invention aims to provide an energy-absorbing rockbolt, which is mainly applied to the supporting of surrounding rock of a roadway (tunnel) under the action of high stress, in a high rockburst-prone area, and with rockburst and rock mass generating brittle-ductile deformation under the action of high stress.

In order to realize the above purpose, the present invention is the following technical scheme:

The energy-absorbing rockbolt provided by the present invention comprises an anchorage structure, wherein one end of the anchorage structure is provided with a mixing blade, and the other end is provided with a threaded fastening section; a nut is screwed to the threaded fastening section; a plate is mounted at one end, which is close to the threaded fastening section, of the anchorage structure in a sleeving manner; one side of the plate abuts against the nut, and the plate is limited by the nut; the anchorage structure consists of first anchorage structure parts and second anchorage structure parts; the second anchorage structure parts are arranged between two first anchorage structure parts; each of the second anchorage structure parts is an elliptical rod-shaped structure; a plurality of inwardly-concave arc-shaped grooves are formed in an outer wall of the second anchorage structure part in an axial direction, and a reinforcing rib is convexly formed at an intersection of two adjacent arc-shaped grooves, so that a section of the second anchorage structure part is in the shape of polygon; and each of the vertices of the polygon is rounded, and each of the edges of the polygon is inwardly concave to form an arc surface.

The section of the second anchorage structure part is in a shape of quadrangle, each of vertices of the quadrangle is rounded, each of edges of the quadrangle is inwardly concave to form an arc surface, and the radians of the arc surfaces are uniform.

The anchorage structure is integrally formed by the first anchorage structure parts and the second anchorage structure parts.

The plate is circular or rectangular in a cross section; a bowl-shaped hole is formed in the center of the plate, the plate is mounted on the anchorage structure in a sleeving manner through the bowl-shaped hole, and one end which is close to the nut, of the bowl-shaped hole, extends toward an outside of the plate to form a bowl-shaped part.

The damping shim is also mounted between the nut and the plate, with a thickness of 1-3 mm.

One end, which is far away from the anchorage structure, of the mixing blade, extends axially to form a boss, and an area of a cross section of the boss is less than that of a cross section of the anchorage structure.

An outer wall of the boss is concave toward an inside of the boss to form an arc surface; and the cross section of the boss is in a shape of rectangle or triangle.

The energy-absorbing rockbolt disclosed by the present invention has the beneficial effects that the rockbolt structure is designed based on the rock dynamics, the principle of energy dissipation, the rock bolting effect, and the like; in the mounting process, through the resin cartridge or cement cartridge placed in the rockbolt hole in a mixing manner by using the mixing blade, the anchoring material (resin, cement, and the like) is uniformly distributed around the rockbolt, so that the rockbolt and the surrounding rock are firmly anchored together; a matched plate, a washer and a nut are mounted at the anchoring section of the rockbolt, the pre-tightening force of the rockbolt is changed by adjusting the positions of the plate and the nut, so that the rockbolt is fixed in the surrounding rock, and the rockbolt not only has the overall sliding energy absorbing capacity of the South Africa cone bolt under dynamic impact, but also has the multi-point anchoring function of the D rockbolt; at the same time, the anchoring between two points generates sliding action, so that the rockbolt not only can move together with the surrounding rock to consume kinetic energy accumulated in the surrounding rock, but also can maintain high anchoring force to maintain the stability of the surrounding rock and a supporting body; under the condition of static ground pressure, the rockbolt has the same mechanism of action as the common resin (cement) rockbolt, but has higher static drawing force than the common rockbolt; and under the action of high stress, rockburst (rockburst) and brittle-ductile deformation, the rockbolt slides rapidly from the resin or cement anchoring agent to absorb the kinetic energy accumulated on the surface of the surrounding rock and maintain the surrounding rock of the roadway stable.

Figure 1:
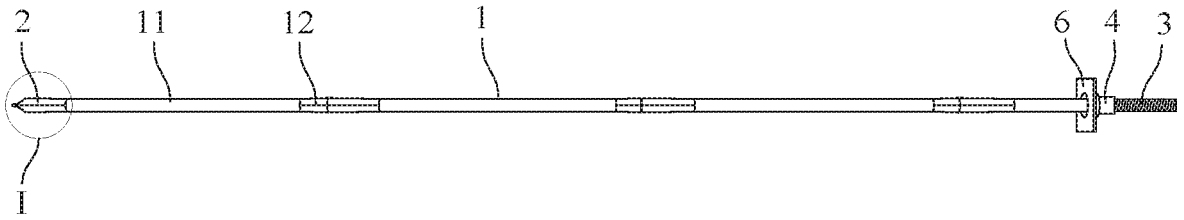
FIG. 1 is a schematic structural diagram of an energy-absorbing rockbolt of the present invention.

In the drawings, 1 indicates anchorage structure, 11 indicates first anchorage structure part, 12 indicates second anchorage structure part, 2 indicates mixing blade, 3 indicates threaded fastening section, 4 indicates nut, 5 indicates damping shim, 6 indicates plate, 7 indicates bowl-shaped hole, 8 indicates bowl-shaped part, and 9 indicates boss.

DETAILED DESCRIPTION OF THE PREFERRED EMBODIMENT

The technical schemes in the embodiments of the present invention are clearly and completely described below with reference to the accompanying drawings in the embodiments of the present invention. Apparently, the embodiments described are merely a part rather than all of the embodiments of the present invention. All other embodiments obtained by those of ordinary skilled in the art without any creative efforts based on the embodiments of the present invention shall fall within the scope of protection of the present invention.

As a note, all directional indications (such as upper, lower, left, right, front, rear, . . . ) in the embodiments of the present invention are only used for explaining the relative positional relationship, the movement among components and the like in a specific posture (as shown in the drawings). If the specific posture is changed, the directional indication also changes accordingly.

In addition, the descriptions of "first", "second" and the like in the present invention are only used for the purpose of description and cannot be interpreted as indicating or implying relative importance or implicitly indicating the number of technical characteristics indicated. Therefore, the characteristics defined by "first" or "second" can include at least one of the characteristics explicitly or implicitly. In addition, the technical schemes of the embodiments can be combined with each other based on the realization by those of ordinary skilled in the art. When the combination of the technical schemes is contradictory or impossible to realize, the combination of the technical schemes should be considered inexistent and is not covered in the scope of protection required by the present invention.

Figure 2:
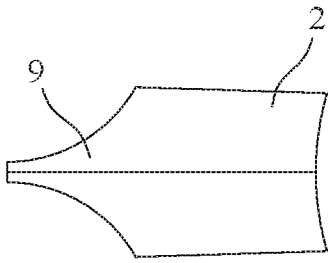
FIG. 2 is an enlarged schematic diagram of I in FIG. 1.
Figure 3:
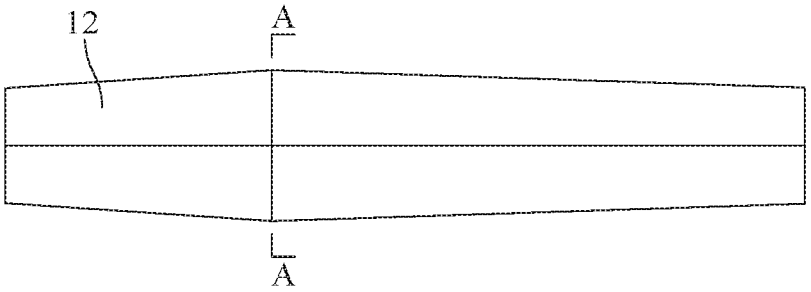
FIG. 3 is a schematic structural diagram of a second anchorage structure part.
Figure 4:
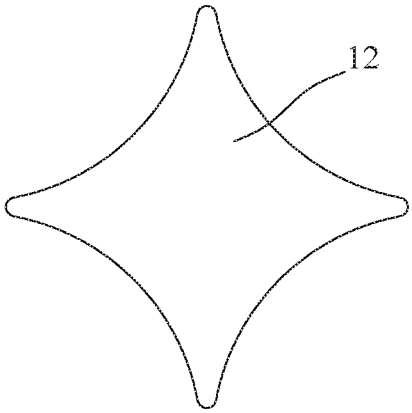
FIG. 4 is a schematic cross sectional view taken along line A-A in FIG. 3.
Figure 5:
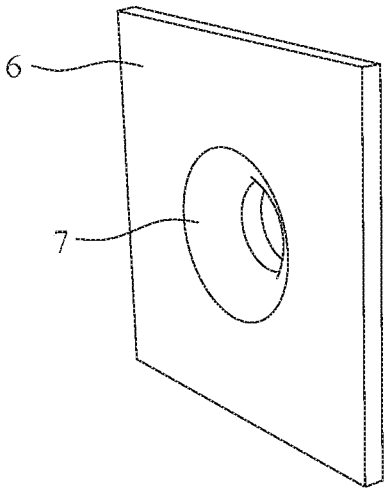
FIG. 5 is a schematic structural diagram of a plate.
Figure 6:
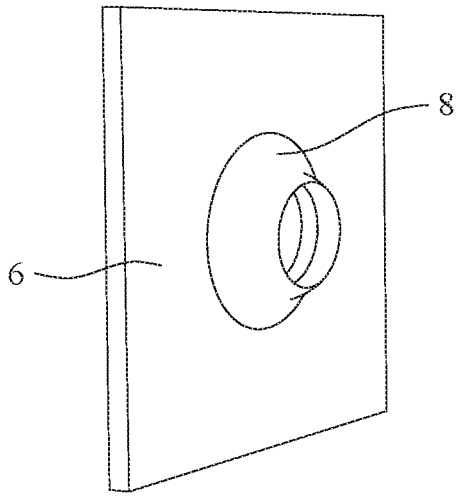
FIG. 6 is a rear view of FIG. 5.
Figure 7:
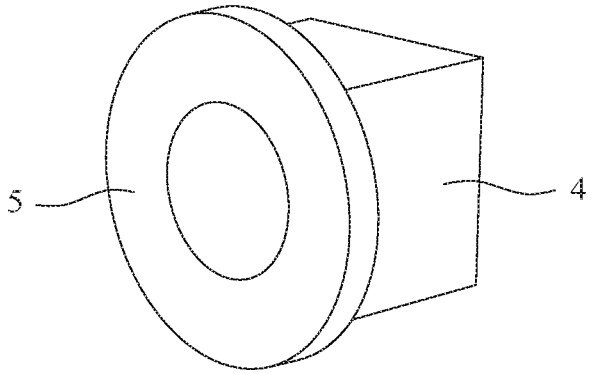
FIG. 7 is a schematic structural diagram of a nut with a spacer.
Figure 8:
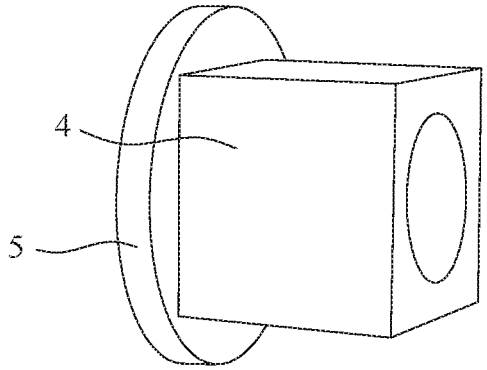
FIG. 8 is a rear view of FIG. 7.
Figure 9:
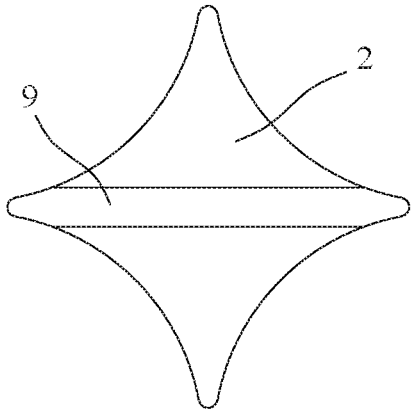
FIG. 9 is a left view of FIG. 2.

As shown in FIG. 1 to FIG. 8, an energy-absorbing rockbolt provided by the present invention comprises an anchorage structure 1 with the diameter of 16 mm-40 mm and the total length of 1200-4000 mm, and the length of the anchorage structure 1 can be increased or decreased according to the mine ground pressure; one end of the anchorage structure 1 is provided with a mixing blade 2, and the other end is provided with a threaded fastening section 3, wherein a nut 4 is screwed to the threaded fastening section 3, and the nut 4 is 30 mm long and is made of low carbon steel; a plate 6 is mounted at one end, which is close to the threaded fastening section 3, of the anchorage structure 1 in a sleeving manner; one side of the plate 6 abuts against the nut 4, and the plate 6 is limited by the nut 4; the anchorage structure 1 consists of first anchorage structure parts 11 and second anchorage structure parts 12; when being stamped, the anchorage structure 1 is integrally formed by the first anchorage structure parts 11 and the second anchorage structure parts 12; the second anchorage structure parts 12 are arranged between two first anchorage structure parts 11; each of the second anchorage structure parts 12 is an elliptical rod-shaped structure, of which the left side and the right side is asymmetric structures, and distances from the two ends to the highest point of an arc surface of the elliptical rod-shaped structure are different; a plurality of inwardly-concave arc-shaped grooves are formed in the outer wall of the second anchorage structure part 12 in the axial direction, and a reinforcing rib is convexly formed at the intersection of two adjacent arc-shaped grooves, so that the section of the second anchorage structure part 12 is in the shape of polygon; each of the vertices of the polygon is rounded, and each of the edges is inwardly concave to form an arc surface; and a damping shim 5 is further arranged between the nut 4 and the plate 6, and the thickness of the damping shim 5 is 0.5-1 mm.

Further, in one of the embodiments, the section of the second anchorage structure part 12 is in the shape of quadrangle and the second anchorage structure part 12 consists of two buckled M shapes; each of the vertices of the quadrangle is rounded, each of the edges is inwardly concave to form an arc surface, and the radians of the arc surfaces are uniform. In other embodiments, the section of each of the second anchorage structure parts 12 can be any polygonal structure.

Further, the plate 6 is circular or rectangular in cross section, with a diameter of 150 mm or an overall dimension of 150 mm*150 mm and a thickness of 5-10 mm; a bowl-shaped hole 7 is formed in the center of the plate 6, the plate 6 is mounted on the anchorage structure 1 in a sleeving manner through the bowl-shaped hole 7, and one end, which is close to the nut 4, of the bowl-shaped hole 7, extends toward the outside of the plate 6 to form a bowl-shaped part 8; and the diameter of the bowl-shaped hole 7 is determined according to the diameter of the rockbolt. If the stress of the surrounding rock is large, the diameter of the plate 6 can be 200 mm or the overall dimensions can be 200 mm*200 mm and the thickness can be 10 mm. The plate 6 is made of low carbon steel by stamping.

Further, the mixing blade 2 is made of round steel by turning, with the length of 50 mm-100 mm and the thickness of 5 mm-15 mm; one end, which is far away from the anchorage structure 1, of the mixing blade 2, extends axially to form a boss 9, and the area of the cross section of the boss 9 is less than that of the cross section of the anchorage structure 1; the outer wall of the boss 9 is concave toward the inside of the boss 9 to form an arc surface; the cross section of the boss 9 is in the shape of rectangle or triangle; when the cross section of the boss 9 is in the shape of rectangle, the radians of two opposite arc surfaces of the rectangle are the same, and the radians of two adjacent arc surfaces are different, so that the boss 9 is a flat structure.

According to the energy-absorbing rockbolt provided by the present invention, wherein each of the second anchorage structure parts 12 appears as a structure formed by buckling double M; the size and the design position of the mixing blade 2 arranged at the end of the anchorage structure 1 and the second anchorage structure parts 12 arranged in the center are designed and adjusted according to the dynamic response characteristics of the rock mass; the anchoring length is the full length, and the anchoring range is between 1.5 m and 3 m; the anchoring material is resin or cement; the length of each of the second anchorage structure parts 12 can be determined according to the actual ground pressure on the site, and adjusted according to the anchoring force and the dynamic response requirements of the rock mass. Each of the second anchorage structure parts 12 not only can realize anchoring at multiple points, but also can absorb energy through tensile or shear deformation between two anchors, and besides, the kinetic energy can be absorbed through the overall sliding of the anchorage structure 1 under the action of dynamic impact.

During the mounting of the rockbolt, the mixing blade 2 uniformly disperses resin or cement around the rockbolt in the borehole, so that the anchorage structure 1 is anchored with the surrounding rock through the uniform resin. The plate 6, the damping shim 5 and the nut 4 are mounted at the end of the anchorage structure 1, so that the rockbolt is further fixed to the surface of the surrounding rock. Under the action of static ground pressure, the mechanism of action of the energy-absorbing rockbolt is the same as that of a common rockbolt. In case of large deformation caused by high stress or dynamic damage caused by rockburst, a damping module acts to cause the damping module to rapidly slide from the resin anchoring agent, and therefore the energy accumulated in the surrounding rock is absorbed. Under the action of high stress, rockburst and brittle-ductile large deformation, the rockbolt can also stay in the resin to play a static anchoring role. That is to say, the rockbolt can be consistent with the deformation of the surrounding rock of the roadway, so that the strain performance of the surrounding rock can be absorbed and the stability of the roadway can be maintained.

To sum up, by designing the rockbolts of different types and different lengths, large deformation and strong rockburst of the surrounding rock of the roadway can be resisted; and the stability of the roadway can be realized, and the potential safety hazard caused by large deformation and rockburst of deep mines can be eliminated.

Finally, it should be noted that the above embodiments are only used for illustrating the technical scheme of the present invention, but the present invention is not limited thereto. Although the present invention is described in details with reference to the above embodiments, those of ordinary skilled in the art should understand that the embodiments of the present invention can be modified or substituted. Any modifications or equivalent substitutions without departing from the spirit and scope of the present invention should be covered in the scope of claims.

What is claimed is:

1. An energy-absorbing rockbolt comprising an anchorage structure, wherein one end of the anchorage structure is provided with a mixing blade, and the other end is provided with a threaded fastening section; a nut is screwed to the threaded fastening section; a plate is mounted at one end, which is close to the threaded fastening section, of the anchorage structure in a sleeving manner; one side of the plate abuts against the nut, and the plate is limited by the nut; the anchorage structure consists of first anchorage structure parts and second anchorage structure parts; the second anchorage structure parts are arranged between two first anchorage structure parts; each of the second anchorage structure parts is an elliptical rod-shaped structure; a plurality of inwardly-concave arc-shaped grooves are formed in an outer wall of the second anchorage structure part in an axial direction, and a reinforcing rib is convexly formed at an intersection of two adjacent arc-shaped grooves, so that a section of the second anchorage structure part is in a shape of polygon; and each of vertices of the polygon is rounded, and each of edges of the polygon is inwardly concave to form an arc surface.

2. The energy-absorbing rockbolt according to claim 1, wherein the section of the second anchorage structure part is in a shape of quadrangle, each of vertices of the quadrangle is rounded, each of edges of the quadrangle is inwardly concave to form an arc surface, and the radians of the arc surfaces are uniform.

3. The energy-absorbing rockbolt according to claim 1, wherein the anchorage structure is integrally formed by the first anchorage structure parts and the second anchorage structure parts.

4. The energy-absorbing rockbolt according to claim 1, wherein the plate is circular or rectangular in a cross section; a bowl-shaped hole is formed in a center of the plate, the plate is mounted on the anchorage structure in a sleeving manner through the bowl-shaped hole, and one end, which is close to the nut, of the bowl-shaped hole extends toward an outside of the plate to form a bowl-shaped part.

5. The energy-absorbing rockbolt according to claim 1, wherein a damping shim is mounted between the nut and the plate, with a thickness of 1-3 mm.

6. The energy-absorbing rockbolt according to claim 1, wherein one end, which is far away from the anchorage structure, of the mixing blade, extends axially to form a boss, and an area of a cross section of the boss is less than that of a cross section of the anchorage structure.

7. The energy-absorbing rockbolt according to claim 6, wherein an outer wall of the boss is concave toward an inside of the boss to form an arc surface.

8. The energy-absorbing rockbolt according to claim 6, wherein a cross section of the boss is in a shape of rectangle or triangle.

* * * * *